US008154364B2

(12) United States Patent
Ohhira

(10) Patent No.: US 8,154,364 B2
(45) Date of Patent: Apr. 10, 2012

(54) HIGH-FREQUENCY TRANSMISSION LINE HAVING GROUND SURFACE PATTERNS WITH A PLURALITY OF NOTCHES THEREIN

(75) Inventor: Risato Ohhira, Tokyo (JP)

(73) Assignee: NEC Corporation, Tokyo (JP)

( * ) Notice: Subject to any disclaimer, the term of this patent is extended or adjusted under 35 U.S.C. 154(b) by 158 days.

(21) Appl. No.: 12/439,589

(22) PCT Filed: Aug. 30, 2007

(86) PCT No.: PCT/JP2007/066896

§ 371 (c)(1),
(2), (4) Date: Mar. 2, 2009

(87) PCT Pub. No.: WO2008/026690

PCT Pub. Date: Mar. 6, 2008

(65) Prior Publication Data

US 2009/0267713 A1 Oct. 29, 2009

(30) Foreign Application Priority Data

Sep. 1, 2006 (JP) ..... 2006-238008

(51) Int. Cl.
*H01P 3/08* (2006.01)

(52) U.S. Cl. ..... 333/238; 333/246

(58) Field of Classification Search ..... 333/238, 333/246, 33, 34

See application file for complete search history.

(56) References Cited

U.S. PATENT DOCUMENTS

| | | | | |
|---|---|---|---|---|
| 6,873,230 | B2 * | 3/2005 | Shirasaki | 333/246 |
| 7,224,249 | B2 * | 5/2007 | van Quach et al. | 333/238 |
| 7,518,473 | B2 * | 4/2009 | Ni | 333/238 |
| 2004/0174228 | A1 * | 9/2004 | Kanno | 333/34 |

FOREIGN PATENT DOCUMENTS

| | | | |
|---|---|---|---|
| JP | 1994224604 | A | 8/1994 |
| JP | 1997046008 | A | 2/1997 |
| JP | 1998200014 | A | 7/1998 |
| JP | 2000022406 | A | 1/2000 |
| JP | 2000216603 | A | 8/2000 |
| JP | 2002252505 | A | 9/2002 |
| JP | 2003124712 | A | 4/2003 |
| JP | 2004140608 | A | 5/2004 |
| JP | 2005109810 | A | 4/2005 |

OTHER PUBLICATIONS

International Search Report for PCT/JP2007/066896 mailed Oct. 2, 2007.

* cited by examiner

*Primary Examiner* — Benny Lee

(57) ABSTRACT

A high-frequency transmission line includes: a dielectric substrate; a signal line formed on one surface of the dielectric substrate; a first and a second surface ground patterns formed so as to sandwich the signal line at a given distance from the signal line on the surface of the dielectric substrate; a backside surface ground pattern formed on another surface of the dielectric substrate; and a plurality of contacts penetrating the dielectric substrate for connecting the first and the second surface ground pattern to the backside surface ground pattern. In a given frequency range, the sum of the shortest distance from any point of the first and the second surface ground patterns to the nearest contact and the thickness of the dielectric substrate is shorter than ¼ of the effective wavelength of a transmission signal converted in the effective permittivity of the dielectric substrate.

8 Claims, 7 Drawing Sheets

-- PRIOR ART --

-- PRIOR ART --

HIGH-FREQUENCY TRANSMISSION LINE HAVING GROUND SURFACE PATTERNS WITH A PLURALITY OF NOTCHES THEREIN

This application is the National Phase of PCT/JP2007/066896, filed Aug. 30, 2007, which claims priority to Japanese Patent Application No. 2006-238008, filed on Sep. 1, 2006.

TECHNICAL FIELD

The present invention relates to a transmission line and in particular, relates to a coplanar line with a backside ground.

BACKGROUND ART

A micro strip line and a coplanar line with a backside ground have often been used as a high-frequency transmission line formed on a dielectric substrate. In the case of the coplanar line with a backside ground in particular, the width of a signal line can freely be set when a desired characteristic impedance is to be obtained since the width of a signal line is not uniquely fixed due to substrate thickness. Additionally, the coplanar line with a backside ground is characterized by low dispersion characteristics and small radiation loss.

In the case of conventional technology, such a connection as a contact, for the purpose of equalizing potentials of a surface ground pattern and a backside ground pattern, electrically connects the ground patterns. This is because the characteristics of the low dispersion characteristics and small radiation loss are not lost even in a high-frequency range where a wavelength of a transmission signal is approximately a dimension of a coplanar line with a backside ground or below.

FIGS. 1 and 2 are a sectional view and a plan view, respectively, of a coplanar line with a backside ground of the conventional example 1. FIGS. 1 and 2 show a signal line 10, a dielectric substrate 20 with a thickness H (FIG. 1), a first surface ground pattern 30*a*, a second surface ground pattern 30*b*, a backside ground pattern 40 (FIG. 1), and a plurality of contacts 50. It is noted that FIG. 1 is a sectional view of the A-A' section depicted in FIG. 2.

The following documents are known in relation to the foregoing.

Japanese Laid Open Patent Application JP-A-Heisei 6-224604 discloses the invention related to a signal line for high-frequency application.

The signal line for high-frequency application according to Japanese Laid Open Patent Application JP-A-Heisei 6-224604 has ground lines arranged on both sides of a signal line which is provided on the surface of an insulating substrate made of a dielectric. Additionally, the signal line for high-frequency application also has a ground plane on the back of the insulating substrate on the lower side of the signal line.

In Japanese Laid Open Patent Application JP-A-Heisei 6-224604, the signal line for high-frequency application has a structure of a coplanar line with a ground. Additionally, the signal line for high-frequency application has a plurality of vias for connecting the ground lines and the ground plane, which are arranged at small pitches near the signal line, on the insulating substrate right under the ground lines.

Japanese Laid Open Patent Application JP-A-Heisei 9-46008 discloses the invention related to a wiring board for high-frequency application.

The wiring board for high-frequency application according to Japanese Laid Open Patent Application JP-A-Heisei 9-46008 is a wiring board in which a ground pattern placed side by side with a signal line on an insulating substrate is electrically connected to a ground through a plurality of conductor vias provided to the insulating substrate. In Japanese Laid Open Patent Application JP-A-Heisei 9-46008, an end portion of the ground pattern is positioned inward compared with an end portion of the insulating substrate. Additionally, a distance L between the end portion of the ground pattern and a portion of the ground pattern which is electrically connected to the conductor via nearest to the end portion is set between less than ¼ of a wavelength λ of a high-frequency signal transmitted through the signal line, and 0.

Japanese Laid Open Patent Application JP-A-Heisei 10-200014 discloses the invention related to a multilayer ceramic wiring substrate.

The multilayer ceramic wiring substrate according to Japanese Laid Open Patent Application JP-A-Heisei 10-200014 contains a wiring layer in which a pair or pairs of signal lines which connect two connection points among connection points positioned on intersection points of a basic grid. In Japanese Laid Open Patent Application JP-A-Heisei 10-200014, at least a part of at least a pair of signal lines among a pair or pairs of signal lines is wired along the shortest rectilinear path which connects connection points positioned on two grid points which are not in the same line of the basic grid.

Japanese Laid Open Patent Application JP-P2002-252505A discloses the invention related to a wiring board for high-frequency application.

The wiring board for high-frequency application according to Japanese Laid Open Patent Application JP-P2002-252505A has an earth conductor, a signal line for high-frequency signal transmission, a same-surface earth conductor, and a through conductor. In Japanese Laid Open Patent Application JP-P2002-252505A, the earth conductor includes a monolayer dielectric layer. Alternatively, the earth conductor is formed on a lower surface of a dielectric substrate formed by stacking a plurality of dielectric layers. Alternatively, the earth conductor is formed between dielectric layers of the dielectric substrate which is formed by stacking a plurality of dielectric layers. Alternatively, one earth conductor is formed on a lower surface of a dielectric substrate formed by stacking a plurality of dielectric layers, and another earth conductor is formed between dielectric layers of the dielectric substrate which is formed by stacking a plurality of dielectric layers. Additionally, the signal line for high-frequency signal transmission is formed on an upper surface of the dielectric substrate. Further, the same-surface earth conductor is formed on both sides of and around the signal line with a given distance. Additionally, the through conductor electrically connects the earth conductor and the same-surface earth conductor. When the minimum distance between the signal line and the earth conductor is H, the distance between the signal line and the same-surface earth conductor is S, and the minimum distance between the end of the same-surface earth conductor on the side of the signal line and the through conductor is L, $H>S$ and $H-S<L<\lambda/4$ (λ is a wavelength of a high-frequency signal which is transmitted through a signal line).

Japanese Laid Open Patent Application JP-P2003-124712A discloses the invention related to a high-frequency transmission line.

The high-frequency transmission line according to Japanese Laid Open Patent Application JP-P2003-124712A has a dielectric, a plurality of ground conductors, a through hole, and a signal conductor. In Japanese Laid Open Patent Application JP-P2003-124712A, the plurality of ground conductors sandwich the dielectric, to be positioned on both sides. The through hole electrically connects the ground conductors positioned on both sides. Additionally, the signal conductor is positioned in the vicinity of the through hole. The high-frequency transmission line according to Japanese Laid Open Patent Application JP-P2003-124712A has a characteristic in that a shape of either or both of the ground conductor and the signal conductor is changed in the vicinity of the through hole in order to prevent a change in a characteristic impedance of the signal conductor due to the through hole.

Japanese Laid Open Patent Application JP-P2005-109810A discloses the invention related to a transmission line.

The transmission line according to Japanese Laid Open Patent Application JP-P2005-109810A has a dielectric substrate, a pattern for transmission, a first pattern for grounding, a second pattern for grounding, and a member for conduction. Here, the pattern for transmission is provided on a first face of the dielectric substrate and transmits a signal. The first pattern for grounding is provided on the first face of the dielectric substrate so as to keep a practically constant distance with both edges of the pattern for transmission. Further, the second pattern for grounding is provided on a second face of the dielectric substrate so as to include a region opposite to the pattern for transmission and the first pattern for grounding. Additionally, the member for conduction makes the first pattern for grounding and the second pattern for grounding conductive.

SUMMARY OF THE INVENTION

An object of the present invention is to provide a coplanar line with a backside ground which can improve reflection characteristics over a wide range, namely, which improves reflection characteristics that gradually degrade from low-frequency waves to high-frequency waves.

Another object of the present invention is to provide a coplanar line with a backside ground in which the distances between contacts do not need to be excessively shortened.

Still another object of the present invention is to provide a coplanar line with a backside ground in which arrangement of contacts on a surface ground does not need to be brought close to a signal line.

A high-frequency transmission line includes a dielectric substrate, a signal line, first and second surface ground patterns, a backside ground pattern and a plurality of contacts. Here, the signal line is formed on one surface of the dielectric substrate. The first and second surface ground patterns are formed on the same surface of the electronic substrate and on both sides of the signal line, separated from the signal line with a given distance. The backside ground pattern is formed on another surface of the dielectric substrate. The plurality of contacts are penetrating the dielectric substrate to connect the first and the second surface ground patterns and the backside ground pattern. A sum of the shortest distance from any point of the first and second surface ground patterns to the nearest one of the plurality of contacts and a thickness of the dielectric substrate is shorter than ¼ of an effective wavelength of a transmission signal corresponding to an effective permittivity of the dielectric substrate in a given frequency range.

It is preferable that each of the plurality of contacts comprises a conductor on a side-surface or within a hole which penetrates the dielectric substrate.

It is preferable that each of the first and the second surface ground patterns comprise a plurality of notches of any shape on each side nearer to the signal line.

It is preferable that the first and the second surface ground patterns comprise a plurality of notches of a shape of a combination of concave arcs on each side nearer to the signal line.

It is preferable that the first and the second surface ground patterns comprises a plurality of notches of any shape on each side further to the signal line.

It is preferable that the first and the second surface ground patterns comprise a plurality of notches of shape of a combination of concave arcs on each side further to the signal line.

A multilayer substrate of the present invention has a high-frequency transmission line of the present invention.

BEST MODE FOR CARRYING OUT THE INVENTION

Exemplary embodiments of a coplanar line with a backside ground according to the present invention will be described below with reference to the attached drawings.

First Exemplary Embodiment

Figure 1:
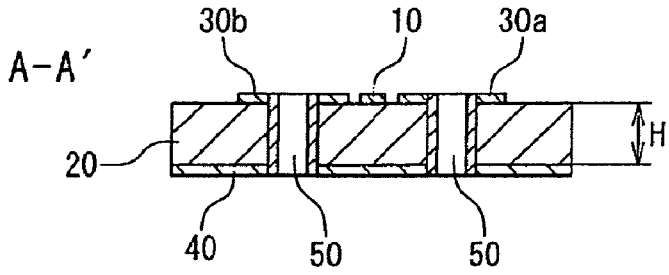
FIG. 1 is a sectional view, denoted by A-A' in FIG. 2, of a high-frequency transmission line according to the conventional example 1.
Figure 2:
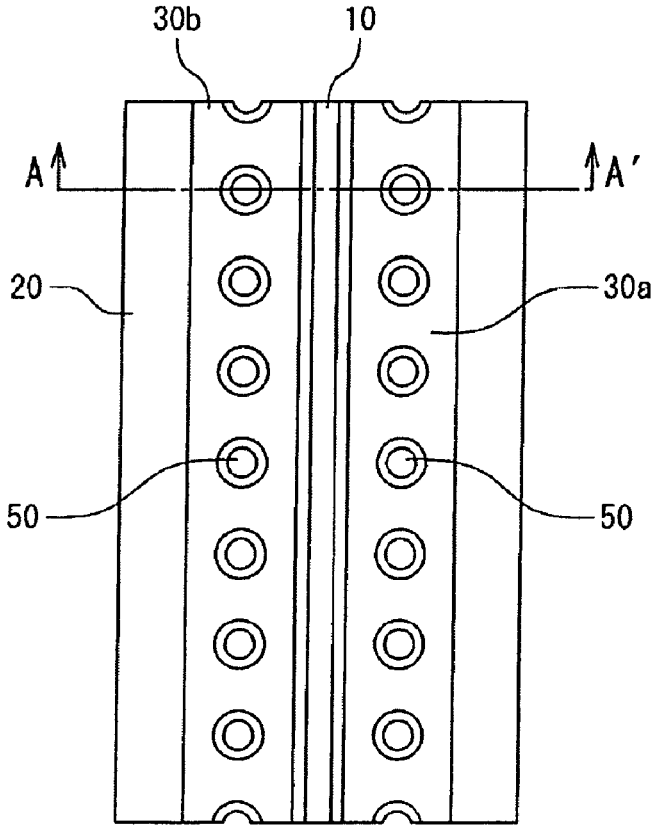
FIG. 2 is a plan view of the high-frequency transmission line according to the conventional example 1.
Figure 3:
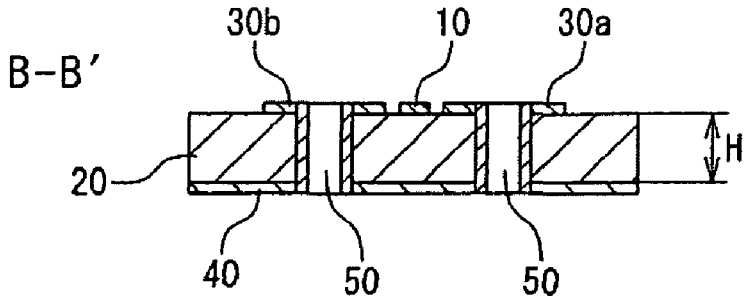
FIG. 3 is a sectional view, denoted by B-B' in FIG. 4, of a high-frequency transmission line according to the first exemplary embodiment of the present invention.
Figure 4:
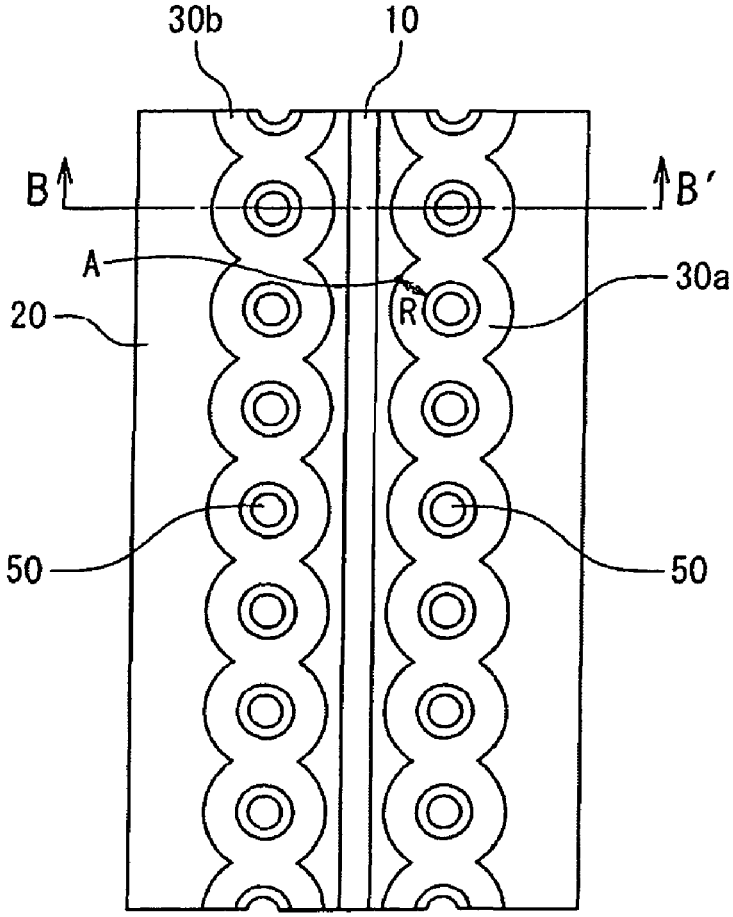
FIG. 4 is a plan view of the high-frequency transmission line according to the first exemplary embodiment of the present invention.

FIGS. 3 and 4 show a high-frequency transmission line according to the first exemplary embodiment of the present invention, where FIG. 3 is a sectional view of the high-frequency transmission line (denoted by B-B' in FIG. 4) and FIG. 4 is a plan view of the high-frequency transmission line. As shown in FIG. 3 and FIG. 4, a coplanar line with a backside ground of the present invention has a dielectric substrate 20, a signal line 10, a first surface ground pattern 30*a*, a second surface ground pattern 30*b*, a backside ground pattern 40 as depicted in FIG. 3) and a plurality of contacts 50. Here, the signal line 10, the first surface ground pattern 30*a* and the second surface ground pattern 30*b* are arranged on one surface of the dielectric substrate 20, the backside ground pattern 40 is arranged on the other surface of the dielectric substrate 20, and the plurality of contacts 50 penetrate the dielectric substrate 20, where substrate 20 is shown in FIG. 3. The first surface ground pattern 30*a* and the second surface ground pattern 30*b* are formed on both sides of the signal line 10 along a transmission direction of the signal line 10. The first surface ground pattern 30*a* and the second surface ground pattern 30*b* are each electrically connected to the backside ground pattern 40 through the plurality of contacts 50 which penetrate the dielectric substrate 20. The plurality of contacts 50 are formed along the transmission direction of the signal line 10 in the first surface ground pattern 30*a* and the second surface ground pattern 30*b*.

The shortest distance from any point A of the first and second surface ground patterns 30*a* and 30*b* to the outer circumference of the nearest contact 50 is set as R, as shown in FIG. 4. Additionally, the substrate thickness of the dielectric substrate 20 is set as H, as shown in FIG. 3. Further, an effective wavelength is set as λe, which is a wavelength at a given frequency calculated by an effective relative permittivity of the transmission line of the exemplary (i.e., the first) embodiment.

At this time, the first and second surface ground patterns 30*a* and 30*b* are formed such that the sum of R and H is ¼ of λe or below. That is to say, as for any point of the first and second surface ground patterns 30*a* and 30*b*, a portion where the sum of R and H exceeds ¼ of λe is removed so that a notch of any shape is correspondingly formed.

In particular, it is preferable when the shape of contacts 50 is circular, that the plurality of notches each should have a shape that is a combination of arcs concentric with the circular contacts 50. This is because the end portions of the notches of the first and second surface ground patterns 30*a* and 30*b* form a group of dots in the same phase. That is to say, a portion where impedance deviation is small can be formed at the end portions of the notches of the first and second surface ground patterns 30*a* and 30*b*. Impedance matching from low-frequency waves to high-frequency waves is more easily achieved since the gap distances between the signal line 10 and the first and second surface ground patterns 30*a* and 30*b* continuously change.

Additionally, the end portions of the notches of the first and second surface ground patterns 30*a* and 30*b* are not limited to a combination of arcs but may be a shape of such a polygon as a triangle and a rectangle.

The dielectric substrate 20 is an alumina substrate with a relative permittivity of 9.9 and a substrate thickness H of 254 μm. The signal line 10 has a width of 130 μm and a length of 6000 μm. The first and second surface ground patterns 30*a* and 30*b* each have a width of 550 μm. Gap distances between the signal line 10 and the first and second surface ground patterns 30*a* and 30*b* are 70 μm. The plurality of contacts 50 each have a diameter of 150 μm, where adjacent contacts 50 are arranged in the transmission direction of the signal line 10 at intervals of 750 μm. The effective relative permittivity of the transmission line is 5.7. Notches of a shape that is a combination of concave arcs are provided to both sides of the first and second surface ground patterns 30*a* and 30*b* respectively, such that the distance R from any point of the first and second surface ground patterns 30*a* and 30*b* to the outer circumference of the nearest contact is 325 μm or below. Additionally, the sum of R and substrate thickness H is 579 μm, with which a frequency corresponding to ¼ of an effective wavelength is approximately 54 GHz after being calculated by an effective relative permittivity of 5.7. Therefore, the notches with which reflection characteristics can be improved up to approximately 54 GHz are provided in the exemplary (i.e., the first) embodiment.

Figure 5:
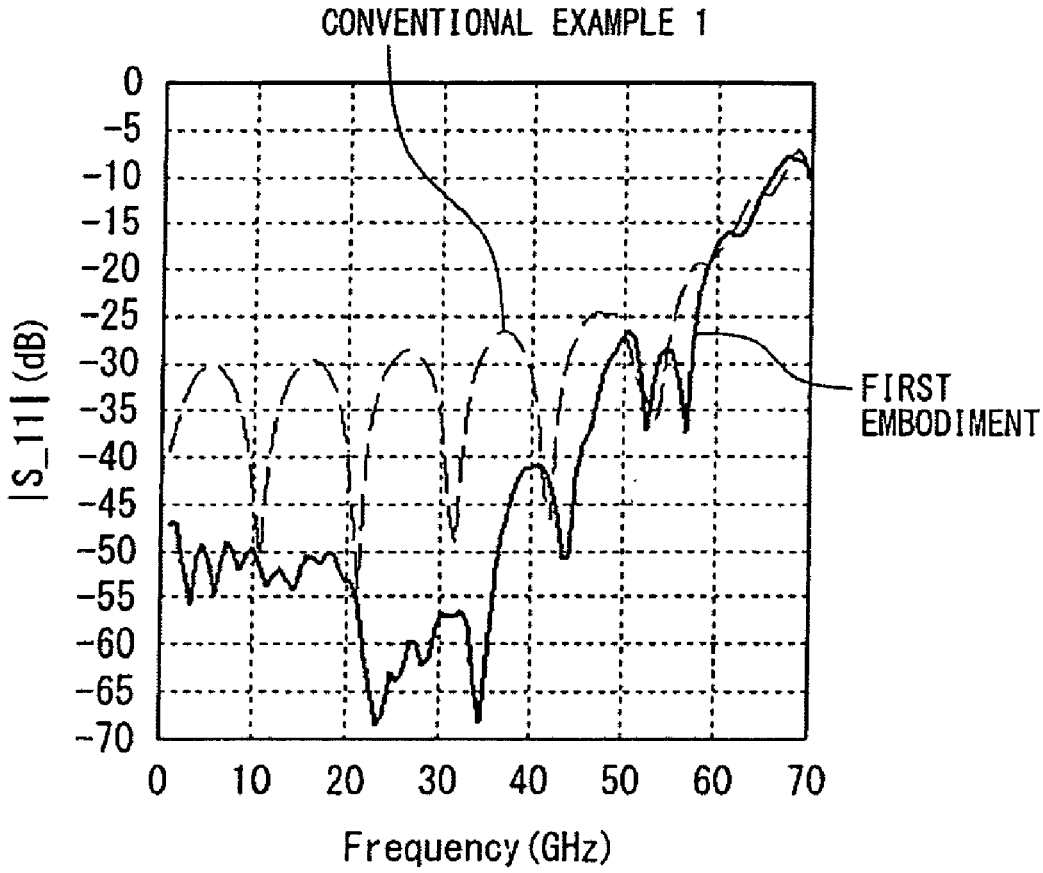
FIG. 5 is a result of electromagnetic field analysis, where a comparison is made between input reflectance characteristics of the high-frequency transmission line according to the conventional example 1 and the high-frequency transmission line according to the first exemplary embodiment of the present invention.

FIG. 5 shows a result of electromagnetic field analysis, where input reflection characteristics are compared between the high-frequency transmission line according to the conventional example 1 and the high-frequency transmission line according to the present exemplary (i.e., the first) embodiment. Here, a bold solid line shows the input reflection characteristic of the high-frequency transmission line according to the exemplary (i.e., the first) embodiment. Additionally, a thin dashed line shows the input reflection characteristic of the high-frequency transmission line according to the conventional example 1. Over a wide band from a low-frequency range to approximately 50 GHz and from approximately 54 GHz to approximately 59 GHz, improvement of the reflection characteristic (i.e., |S11| in dB) according to the exemplary (i.e., the first) embodiment of the present invention can be obtained.

Second Exemplary Embodiment

Figure 6:
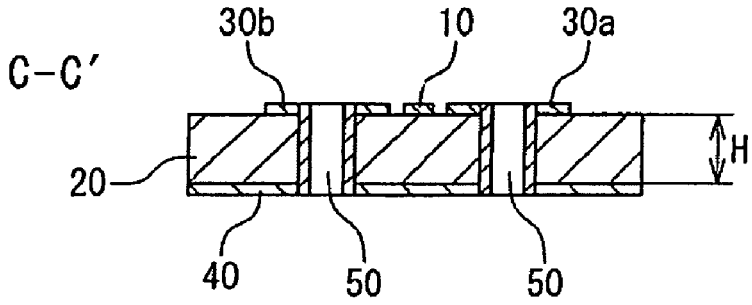
FIG. 6 is a sectional view, denoted by C-C' in FIG. 7, of a high-frequency transmission line according to the second exemplary embodiment of the present invention.
Figure 7:
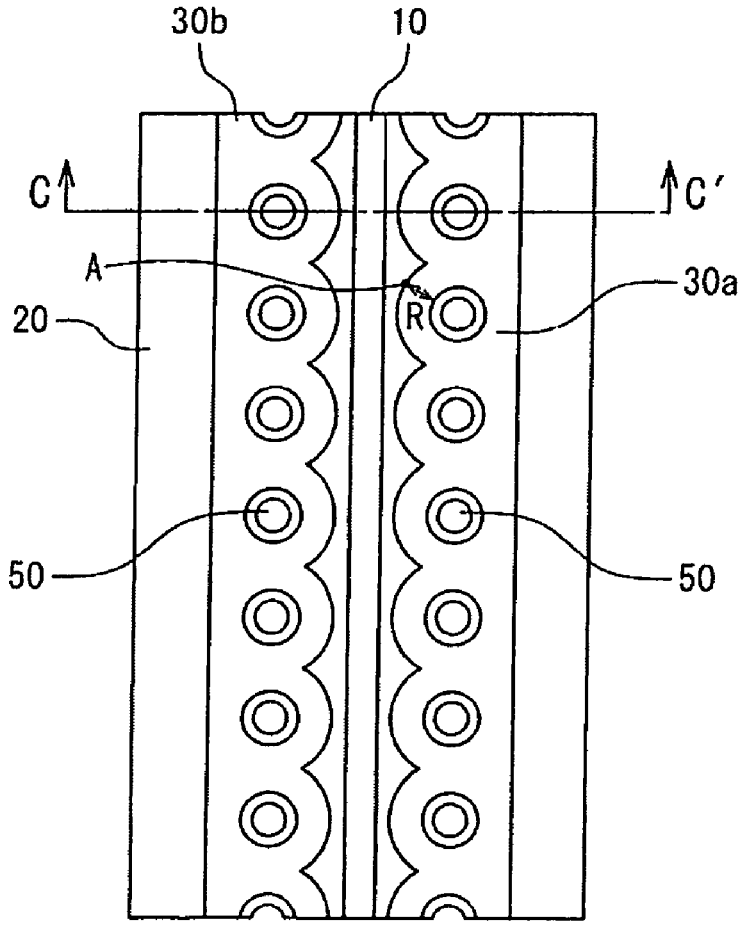
FIG. 7 is a plan view of the high-frequency transmission line according to the second exemplary embodiment of the present invention.

FIG. 6 and FIG. 7 show a high-frequency transmission line according to the second exemplary embodiment of the present invention, where FIG. 6 is a sectional view (denoted by C-C' in FIG. 7) of the high-frequency transmission line and FIG. 7 is a plan view of the high-frequency transmission line. As shown in FIG. 6 and FIG. 7, a coplanar line with a backside ground of the present invention has a dielectric substrate 20, a signal line 10, a first surface ground pattern 30*a*, a second surface ground pattern 30*b*, a backside ground pattern 40 (as shown in FIG. 6) and a plurality of contacts 50, as in the case of the first exemplary embodiment. The signal line 10, the first surface ground pattern 30*a* and the second surface ground pattern 30*b* are arranged on one surface of the dielectric substrate 20, the backside ground pattern 40 is arranged on the other surface of the dielectric substrate 20, and the plurality of contacts 50 penetrate the dielectric substrate 20 (as shown in FIG. 7), as in the case of the first exemplary embodiment. The shortest distance from any point A of the first and second surface ground patterns 30*a* and 30*b* to the outer circumference of the nearest contact 50 is set as R, as shown in FIG. 7. There are two differences between the first exemplary embodiment and the present exemplary embodiment. One is that positions of contacts in the width direction of the first and second surface ground patterns 30*a* and 30*b* are placed at the center of the width direction or opposite to the signal line 10 from the center. The other is that notches with which the sum of R as shown in FIG. 7) and H as shown in FIG. 6) is ¼ of λe or below are provided only to the sides of the first and second surface ground patterns 30*a* and 30*b* near to the signal line. No notches are provided to the sides opposite to the signal line, as in the case of the conventional example 1.

The dielectric substrate 20 is an alumina substrate with a relative permittivity of 9.9 and a substrate thickness H of 254 μm. The signal line 10 has a width of 130 μm and a length of 6000 μm. The first and second surface ground patterns 30*a* and 30*b* each have a width of 550 μm. Gap distances between the signal line 10 and the first and second surface ground patterns 30*a* and 30*b* are 70 μm. The plurality of contacts 50 each have a diameter of 150 μm, where adjacent contacts 50 are arranged in a transmission direction of the signal line 10 at intervals of 750 μm. An effective relative permittivity of the transmission line is 5.7. Notches of a shape that is a combination of concave arcs are provided to the first and second surface ground patterns 30*a* and 30*b* only on the sides of the signal line 10 such that the distance R from any point of the first and second surface ground patterns 30*a* and 30*b* to the outer circumference of the nearest contact is 325 μm or below, as shown in FIG. 7. Additionally, the sum of R and substrate thickness H is 579 μm, with which a frequency corresponding to ¼ of an effective wavelength is approximately 54 GHz after being calculated by an effective relative permittivity of 5.7. Therefore, notches with which reflection characteristics can be improved up to approximately 54 GHz are provided in the exemplary (i.e., the second) embodiment.

Figure 8:
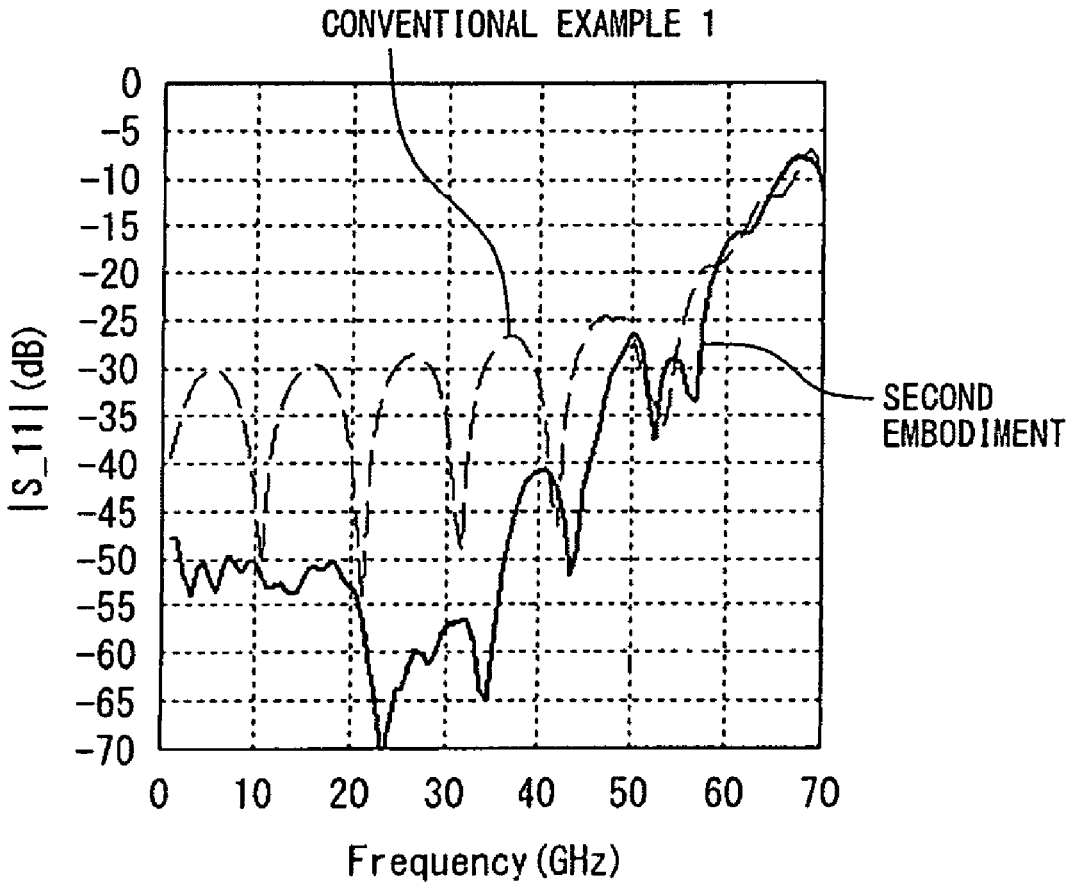
FIG. 8 is a result of electromagnetic field analysis, where a comparison is made between input reflectance characteristics of the high-frequency transmission line according to the conventional example 1 and the high-frequency transmission line according to the second exemplary embodiment of the present invention.

FIG. 8 shows a result of electromagnetic field analysis, where input reflection characteristics are compared between the high-frequency transmission line according to the conventional example 1 and the high-frequency transmission line according to the present exemplary embodiment. Here, a bold solid line shows the input reflection characteristic of the high-frequency transmission line according to the exemplary (i.e., the second) embodiment. Additionally, a thin dashed line shows the input reflection characteristic of the high-frequency transmission line according to the conventional example 1. Over a wide band from a low-frequency range to approximately 50 GHz and from approximately 54 GHz to approximately 59 GHz, improvement of the reflection characteristic (i.e., |S11| in dB) according to the exemplary (i.e., the second) embodiment of the present invention can be obtained.

Third Exemplary Embodiment

Figure 9:
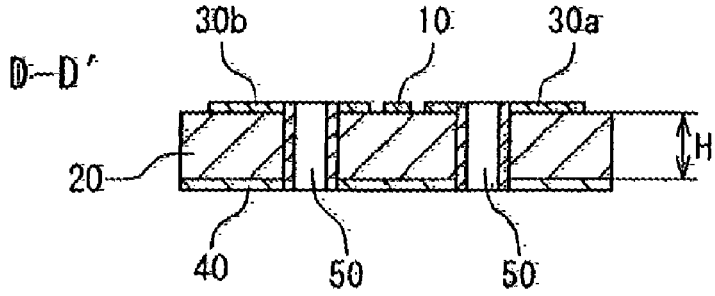
FIG. 9 is a sectional view, denoted by D-D' in FIG. 10, of a high-frequency transmission line according to the third exemplary embodiment of the present invention.
Figure 10:
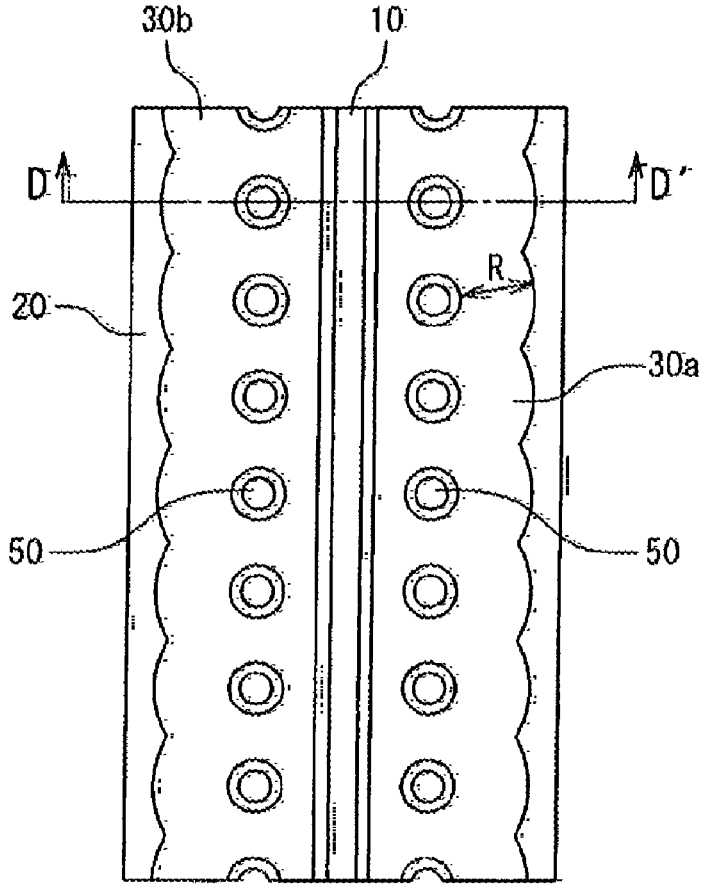
FIG. 10 is a plan view of the high-frequency transmission line according to the third exemplary embodiment of the present invention.

FIG. 9 and FIG. 10 show a high-frequency transmission line according to the third exemplary embodiment of the present invention, where FIG. 9 is a sectional view (denoted by D-D' in FIG. 10) of the high-frequency transmission line and FIG. 10 is a plan view of the high-frequency transmission line. As shown in FIG. 9 and FIG. 10, a coplanar line with a backside ground of the present invention has a dielectric substrate 20, a signal line 10, a first surface ground pattern 30*a*, a second surface ground pattern 30*b*, a backside ground pattern 40 (as depicted in FIG. 9) and a plurality of contacts 50, as in the case of the first or second exemplary embodiment. Here, the signal line 10, the first surface ground pattern 30*a* and the second surface ground pattern 30*b* are arranged on one surface of the dielectric substrate 20, the backside ground pattern 40 is arranged on the other surface of the dielectric substrate 20, and the plurality of contacts 50 penetrate the dielectric substrate 20 (as shown in FIG. 9), as in the case of the first or second exemplary embodiment. There are two differences between the first or second exemplary embodiment and the present exemplary embodiment. One is that positions of contacts in the width direction of the first and second surface ground patterns 30*a* and 30*b* are placed at the center of the width direction or nearer to the signal line 10 from the center. The other is that notches with which the sum of R as in FIG. 10) and H as in FIG. 9) is ¼ of λe or below are provided only to the sides of the first and second surface ground patterns 30*a* and 30*b* opposite to the signal line. No notches are provided to the sides near to the signal line, as in the case of the conventional example 2.

The dielectric substrate 20 is an alumina substrate with a relative permittivity of 9.9 and a substrate thickness H of 254 μm. The signal line 10 has a width of 130 μm and a length of 6000 μm. The first and second surface ground patterns 30*a* and 30*b* each have a width of 750 μm. Gap distances between the signal line 10 and the first and second surface ground patterns 30*a* and 30*b* are 70 μm. The plurality of contacts 50 each have a diameter of 150 μm, where adjacent contacts 50 are arranged in a transmission direction of the signal line 10 at intervals of 750 μm. The respective contacts are arranged nearer by 200 μm, to the signal line from the center of the width direction of the first and second surface ground patterns. The effective relative permittivity of the transmission line is 5.7. As shown in FIG. 10, notches of a shape that is a combination of concave arcs are provided to the first and second surface ground patterns 30*a* and 30*b* only on the sides opposite to the signal line 10 such that a distance R from any point of the first and second surface ground patterns 30*a* and 30*b* to the outer circumference of the nearest contact is 400 μm or below. Additionally, the sum of R and substrate thickness H is 654 μm, with which a frequency corresponding to ¼ of an effective wavelength is approximately 50 GHz after being calculated by an effective relative permittivity of 5.7. Therefore, notches with which reflection characteristics can be improved up to approximately 50 GHz are provided in the exemplary (i.e., the third) embodiment.

Figure 11:
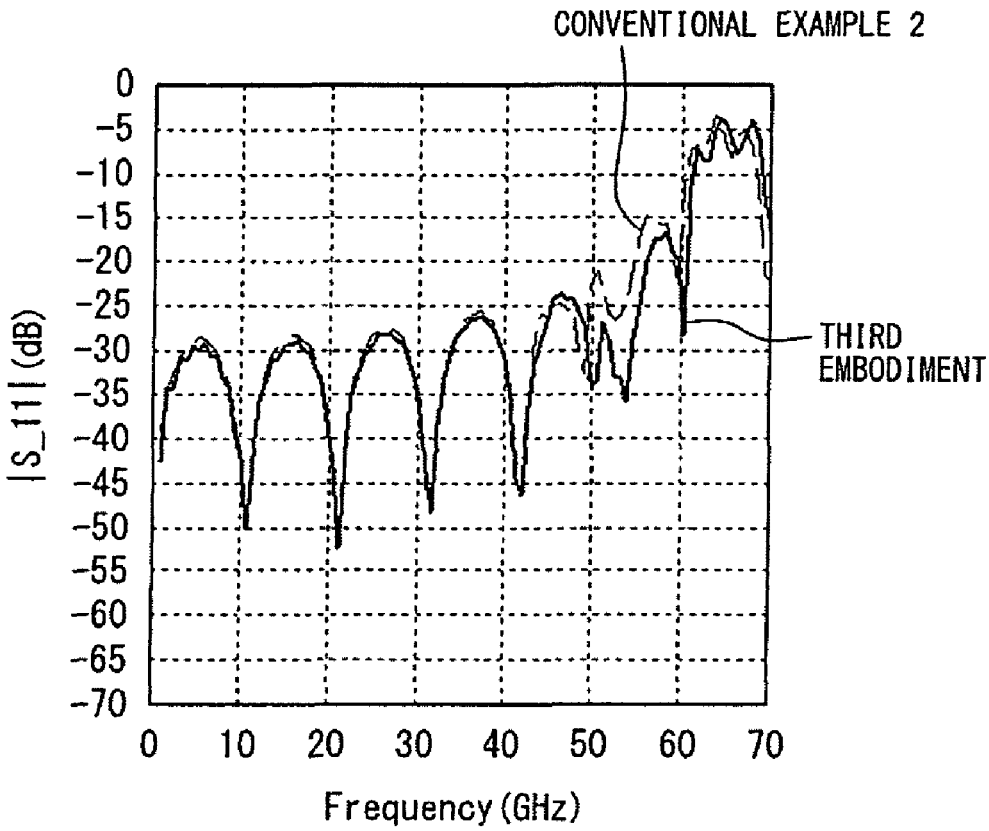
FIG. 11 is a result of electromagnetic field analysis, where a comparison is made between input reflectance characteristics of the high-frequency transmission line according to the conventional example 2 and the high-frequency transmission line according to the third exemplary embodiment of the present invention.

FIG. 11 shows a result of electromagnetic field analysis, where input reflection characteristics are compared between the high-frequency transmission line according to the conventional example 2 and the high-frequency transmission line according to the present exemplary embodiment. Here, a bold solid line shows the input reflection characteristic of the high-frequency transmission line according to the exemplary (i.e., the third) embodiment. Additionally, a thin dashed line shows the input reflection characteristic of the high-frequency transmission line according to the conventional example 2. There are two differences between the conventional example 2 and the conventional example 1. One is that the widths of the first and second surface ground patterns are 750 μm, as in the case of the present exemplary embodiment. The other is that the respective contacts are arranged nearer by 200 μm, to the signal line from the center of the width direction of the first and second surface ground patterns, as in the case of the present exemplary embodiment. Over a wide band from approximately 49 GHz to approximately 58 GHz, improvement of the reflection characteristic (i.e., |S11| in db) according to the exemplary (i.e., the third) embodiment of the present invention can be obtained.

Other Exemplary Embodiments: Part 1

Although the most basic case where the signal line 10 is a straight line, is mentioned in the above-mentioned first to third exemplary embodiments, the signal line 10 does not necessarily need to be a straight line. That is to say, the signal line 10 may be bent halfway or may branch. In any case, it is unchanged that the surface ground patterns 30*a* and 30*b* are formed by being separated from the signal line 10 for a given distance. Additionally, it is also unchanged that notches are provided to both sides or one side of the surface ground patterns 30*a* and 30*b* in the range where the sum of R and H does not exceed ¼ of an effective wavelength as mentioned above. Furthermore, it is also unchanged that the notches are formed in a shape that is a combination of arcs concentric with contacts or of other arbitrary shapes.

Other Exemplary Embodiments: Part 2

Although in the exemplary (i.e., third) embodiments, the number of the dielectric substrate 20 is one, as mentioned above, the number of the dielectric substrate 20 does not necessarily need to be one. That is to say, the present invention is also applicable to a multilayer substrate in which two or more of the dielectric substrates 20 are stacked. The signal line 10 and the first and second surface ground patterns 30*a* and 30*b* may be formed in the dielectric substrate.

According to the present invention, the first and second surface ground patterns are formed such that the shortest distance from any point of the first and second surface ground patterns to the nearest contact is within a given value. As a result, an increase in impedance deviation of the first and second surface ground patterns following an increase in a frequency is curbed. Therefore, reflection characteristics of a transmission line are improved over a wide frequency range.

On the other hand, it is possible to increase distances between contacts for connecting the first and second surface ground patterns and the backside ground pattern, compared with the conventional example 1. That is to say, since the total number of contacts is saved, reduction in strength due to contacts can be prevented and there are also advantages in terms of time and costs required for manufacturing.

In addition, the present invention achieves excellent reflection characteristics while leaving sufficient widths between the contacts and the signal line in the first and second surface ground patterns. That is to say, margins in the first and second surface ground patterns are sufficiently secured in providing contacts to a dielectric substrate, greatly lowering the degrees of difficulty and precision required at manufacturing process compared with the conventional example 1.

What is claimed is:

1. A high-frequency transmission line comprising:

a dielectric substrate, a signal line disposed on one surface of said dielectric substrate, a first and a second surface ground patterns disposed on said one surface of said dielectric substrate and on both sides of said signal line, separated from said signal line with a given distance, a backside ground pattern disposed on another surface of said dielectric substrate, and a plurality of contacts penetrating said dielectric substrate to connect said first and said second surface ground patterns and said backside ground pattern;

wherein a sum of the shortest distance from any point of the first and second surface ground patterns to the nearest one of said plurality of contacts and a thickness of said dielectric substrate is shorter than ¼ of an effective wavelength of a transmission signal corresponding to an effective permittivity of said dielectric substrate in a given frequency range, wherein a plurality of notches of any shape are formed on each side near said signal line of said first and second surface ground patterns in succession along the length of said first and second surface ground patterns.

2. The high-frequency transmission line according to claim 1, wherein said first and said second surface ground patterns comprise said plurality of notches of a shape of a combination of concave arcs on each side nearer to said signal line.

3. The high-frequency transmission line according to claim 2, wherein said first and said second surface ground patterns comprise said plurality of notches of any shape on each side further to said signal line.

4. The high-frequency transmission line according to claim 2, wherein said first and said second surface ground patterns comprise said plurality of notches of a shape of a combination of concave arcs on each side further to said signal line.

5. A substrate comprising a high-frequency transmission line, said high-frequency transmission line comprising:

a dielectric substrate, a signal line disposed on one surface of said dielectric substrate, a first and a second surface ground patterns disposed on said one surface of said dielectric substrate and on both sides of said signal line, separated from said signal line with a given distance, a backside ground pattern disposed on another surface of said dielectric substrate, and a plurality of contacts penetrating said dielectric substrate to connect said first and said second surface ground patterns and said backside ground pattern;

wherein a sum of the shortest distance from any point of the first and second surface ground patterns to the nearest one of said plurality of contacts and a thickness of said dielectric substrate is shorter than ¼ of an effective wavelength of a transmission signal corresponding to an effective permittivity of said dielectric substrate in a given frequency range, wherein a plurality of notches of any shape are formed on each side near said signal line of said first and second surface ground patterns in succession along the length of said first and second surface ground patterns.

6. The substrate according to claim 5, wherein said first and said second surface ground patterns comprise said plurality of notches of a shape of a combination of concave arcs on each side further to said signal line.

7. The substrate according to claim 5, wherein said first and said second surface ground patterns comprise said plurality of notches of any shape on each side further to said signal line.

8. The substrate according to claim 5, wherein said first and said second surface ground patterns comprise said plurality of notches of any shape on each side nearer to said signal line.

* * * * *